US005720084A

United States Patent [19]

Chen

[11] Patent Number: 5,720,084

[45] Date of Patent: Feb. 24, 1998

[54] SECURING DEVICE FOR FOOTWEAR

[76] Inventor: Chin Chu Chen, No. 23, Alley 33, Lane 24, Sec 3, Chung Yang Road, Lung-Ching Hsiang, Taichung Shien, Taiwan

[21] Appl. No.: 775,148

[22] Filed: Dec. 31, 1996

[51] Int. Cl.[6] ..... A43C 11/14

[52] U.S. Cl. ..... 24/68 SK; 24/71 SK; 24/70 SK; 24/68 A

[58] Field of Search ..... 24/68 SK, 70 SK, 24/68 A, 70 R, 71 SK, 70 ST, 69 SK, 68 R, 71 ST; 36/50.5

[56] References Cited

U.S. PATENT DOCUMENTS

| | | | |
|---|---|---|---|
| 4,193,171 | 3/1980 | Lichowsky | 24/68 SK |
| 4,547,980 | 10/1985 | Olivieri | 24/70 SK X |
| 4,651,392 | 3/1987 | Olivieri | 24/71 SK |
| 4,670,946 | 6/1987 | Olivieri | 24/71 ST X |
| 4,852,222 | 8/1989 | Courvoisier et al. | 24/71 SK X |
| 5,379,531 | 1/1995 | Iwama | 24/68 SK X |
| 5,606,779 | 3/1997 | Lu | 24/68 SK |

FOREIGN PATENT DOCUMENTS

| | | | |
|---|---|---|---|
| 401202 | 12/1990 | European Pat. Off. | 24/68 SK |

*Primary Examiner*—Peter M. Cuomo
*Assistant Examiner*—Hanh V. Tran
*Attorney, Agent, or Firm*—Bacon & Thomas

[57] ABSTRACT

A securing device includes a base capable of being fixedly disposed on a side of a footwear, a receiving member pivotally connected to the base, a toothed band having a head pivotally connected to the receiving member and an actuating member slidably received in grooves defined in the receiving member. The base has a first hook member extending upwardly therefrom. Two springs are disposed between the receiving member and the actuating member which has a second hook member extending downwardly from a bottom thereof so as to be engaged with the first hook member. The actuating member has two stops extending from the bottom thereof and the receiving member has two slots defined therein for the stops to be movably received therein such that when pushing the actuating member toward the head of the toothed band, the first hook member and the second hook member are disengaged from each other so that the receiving member together with the head of the toothed band can be pivoted to loosen the toothed band.

2 Claims, 4 Drawing Sheets

SECURING DEVICE FOR FOOTWEAR

BACKGROUND OF THE INVENTION

1. Field of the Invention

The present invention relates to a securing device and, more particularly, to an improved securing device for footwear, such as a ski boot.

2. Brief Description of the Prior Art

A securing device for footwear includes a toothed band, a base being fixedly disposed to one side of a ski boot, a receiving member being pivotally connected to the base wherein the toothed band having one end pivotally disposed to the receiving member and a fixing member disposed to the other side of the ski boot such that the other end of the toothed band is securely positioned in the fixing member. The receiving member has a ratchet extending downwardly such that when securing the securing device, a user pulls the toothed band toward the receiving member and then pivotally presses the receiving member toward a direction opposite to the fixing member so as to pull the toothed band toward a direction opposite to the fixing member and make the ratchet be engaged with the toothed band to fixedly position the toothed band. When disengaging the securing device, the user pulls the receiving member upwardly to remove the ratchet of the receiving member from the toothed band such that the toothed band is loosened and the securing device is opened. However, it is experienced that an accidental impact of the receiving member leads an opening of the securing device. This could cause a dangerous result. In order to provide a solution to the problem described above invention entitled as "SECURING DEVICE, PARTICULARLY FOR FOOTWEAR" is developed and is patented on Dec. 22, 1992, U.S. Pat. No. 5,172,454 to Martignago.

The present invention intends to provide an improved securing device for footwear to mitigate and/or obviate the above-mentioned problems.

SUMMARY OF THE INVENTION

The present invention provides a securing device which comprises a base having a bottom capable of being fixedly disposed on a footwear, two lugs extend upwardly from two opposite sides of the bottom, and a first hook member extending upwardly from the bottom.

A receiving member have a U-shaped configuration includes a transverse portion and two arms which respectively extend from two opposite ends of the transverse portion so as to be pivotally connected between the two lugs of the base. The transverse portion has two extending portions respectively extending downwardly from two opposite sides thereof and each of the two extending portions has a first flange extending laterally and inwardly from an inner side thereof so as to define a groove in the respective inner side of the extending portions. Each of the first flanges has a slot defined therethrough.

An actuating member is slidably received in the grooves and has two rods extending longitudinally therefrom, a spring mounted on each of the rods and the two springs contact against a close end of each of the grooves. The actuating member has two stops extending downwardly from a bottom thereof so as to be movably inserted into the slots of the first flanges. A second hook member extends downwardly from the bottom of the actuating member for engagememt with the first hook member of the base.

A toothed band having one end with a head which is pivotally connected between the two arms. The first hook member and the second hook member are disengaged from each other by pushing the actuating member toward the head of the toothed band so as to allow the receiving member together with the head of the toothed band to be pivoted to loosen the toothed band.

It is an object of the present invention to provide a securing device which is operated by pushing an actuating member.

It is another object of the present invention to provide a securing device which prevents an unintentional opening of the device.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
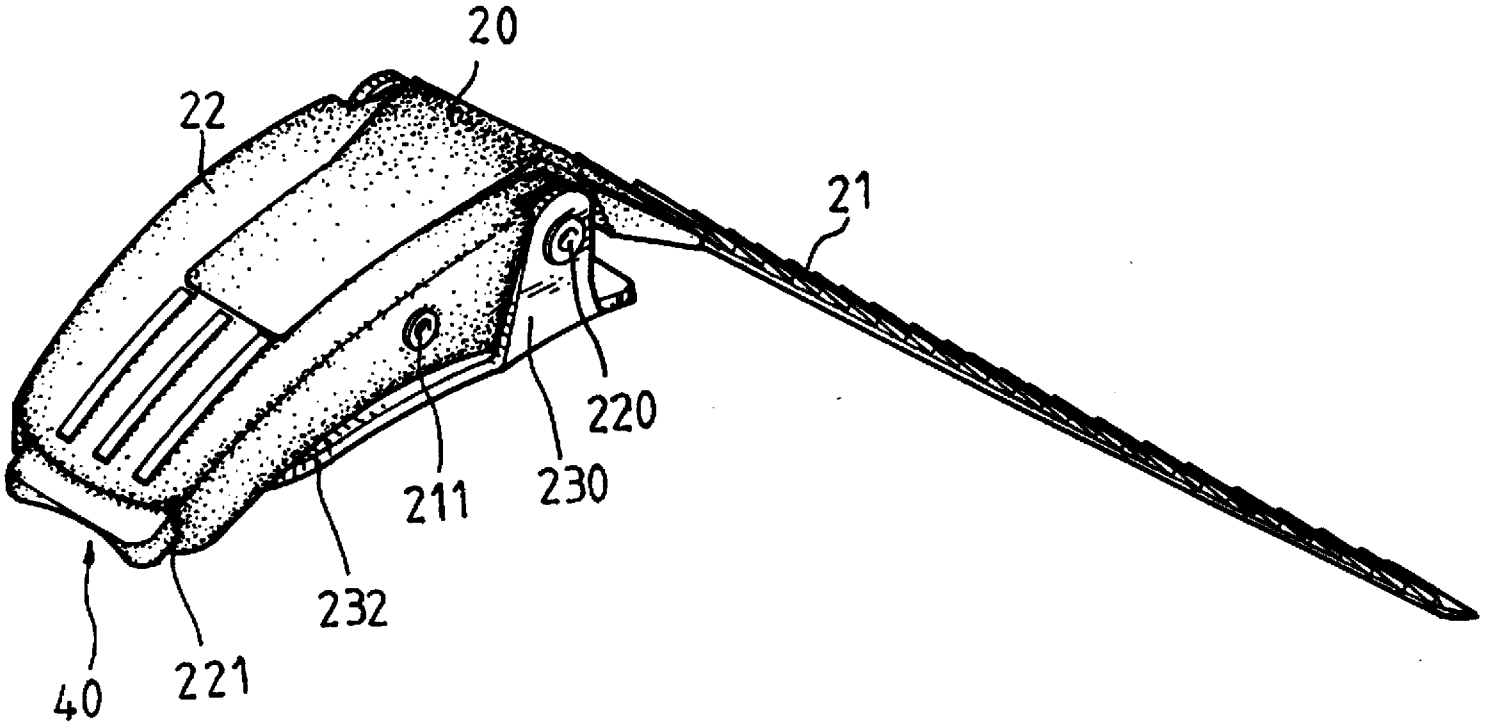
FIG. 1 is a perspective view of a securing device in accordance with the present invention.
Figure 2:
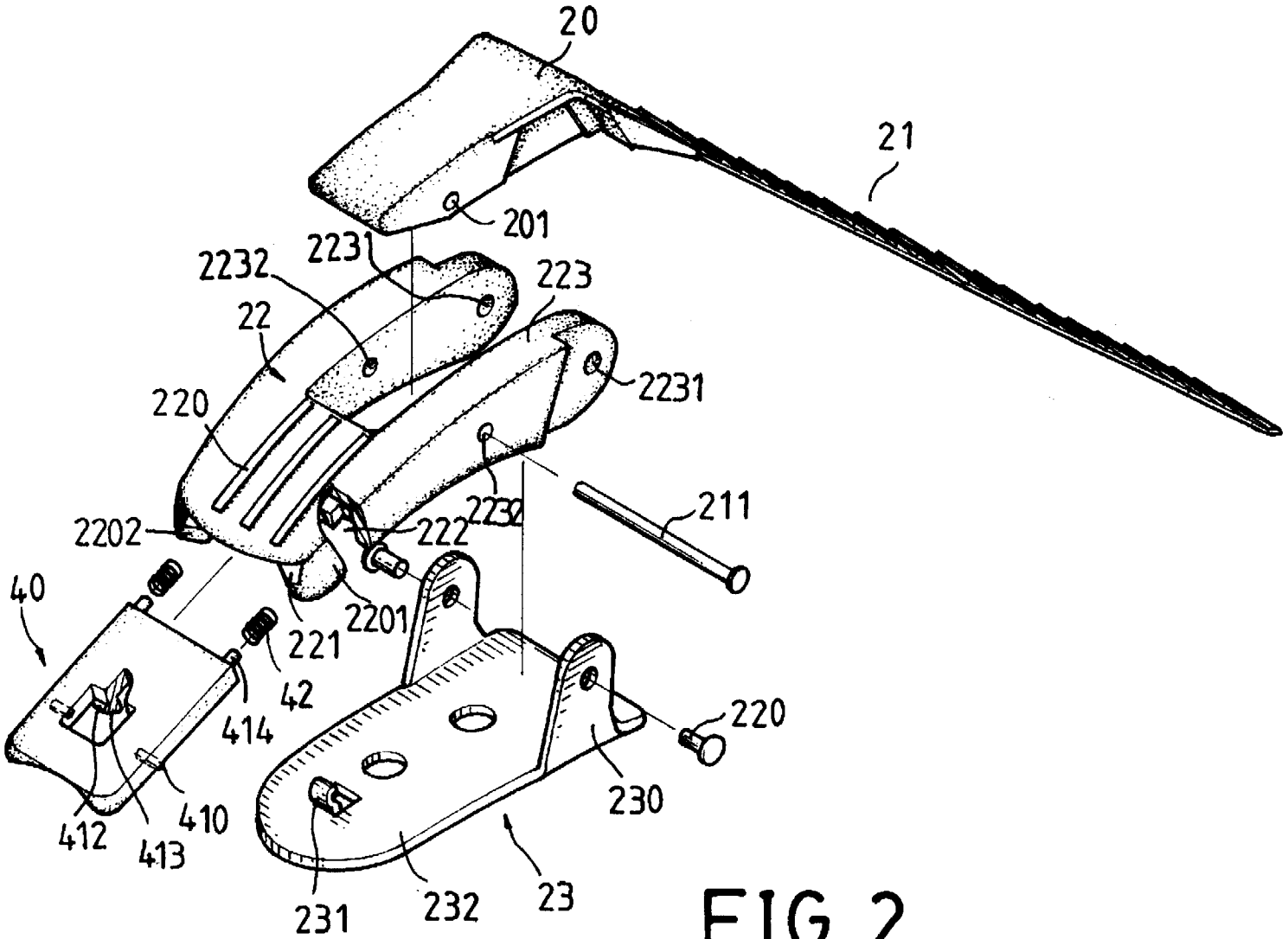
FIG. 2 is an exploded view of the securing device in accordance with the present invention.
Figure 3:
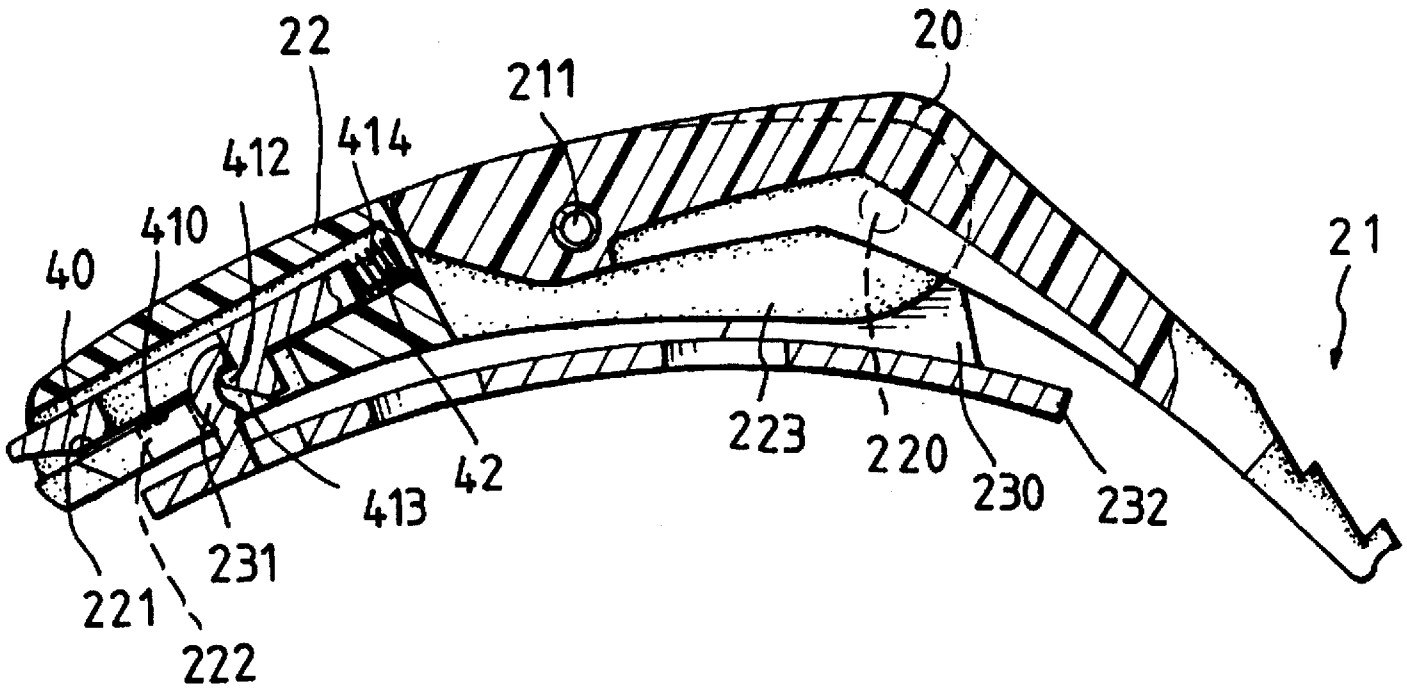
FIG. 3 is a side elevational view, partly in section, of the securing device in accordance with the present invention.

Referring to the drawings and initially to FIGS. 1 through 3, a securing device for footwear in accordance with the present invention generally includes a base 23 having a bottom 232 fixedly disposed to one side of the footwear 10 (shown in FIG. 4) and two lugs 230 extending upwardly from two opposite sides of the bottom 232. The bottom 232 has a first hook member 231 extending upwardly therefrom.

A receiving member 22 having a U-shaped configuration includes a transverse portion 220 and two arms 223 which respectively extend from two opposite ends of the transverse portion 220. Each of the arms 223 has a first hole 2231 defined transversely therethrough so that the two arms 223 may be pivotally connected to the two lugs 230 of the base 23 by two rivets 220 extending through the two lugs 230 and the first holes 2231. The transverse portion 220 has two portions 2201 respectively extending downwardly from two opposite sides thereof and each of the two extending portions 2201 has a first flange 2202 extending laterally and inwardly from an inner side thereof so as to define a groove 221 in the respective inner side of each of the extending portions 2201 between the transverse portion 220 and the respective first flange 2202. Each of the first flanges 2202 has a slot 222 defined therethrough.

An actuating member 40 is slidably received in the grooves 221 and has two rods 414 extending longitudinally from one end thereof so as to mount a spring 42 on each of the rods 414 wherein the two springs 42 contact against a close end of each of the grooves 221. The actuating member 40 has two stops 410 extending downwardly from a bottom of two opposite sides thereof so as to be movably inserted into the slots 222 of the first flanges 2202 and a second hook member 412 extends downwardly from the bottom of the actuating member 40 so as to be engaged with the first hook member 231 of the base 23. The second hook member 412 has an inclined surface 413 defined in a free end thereof.

A toothed band 21 has a head 20 formed to one end thereof and the head 20 is pivotally connected between the two arms 223 by extending a pin 211 through a second hole 2232 defined transversely through each of the two arms 223 and a third hole 201 defined transversely through the head 20.

Figure 4:
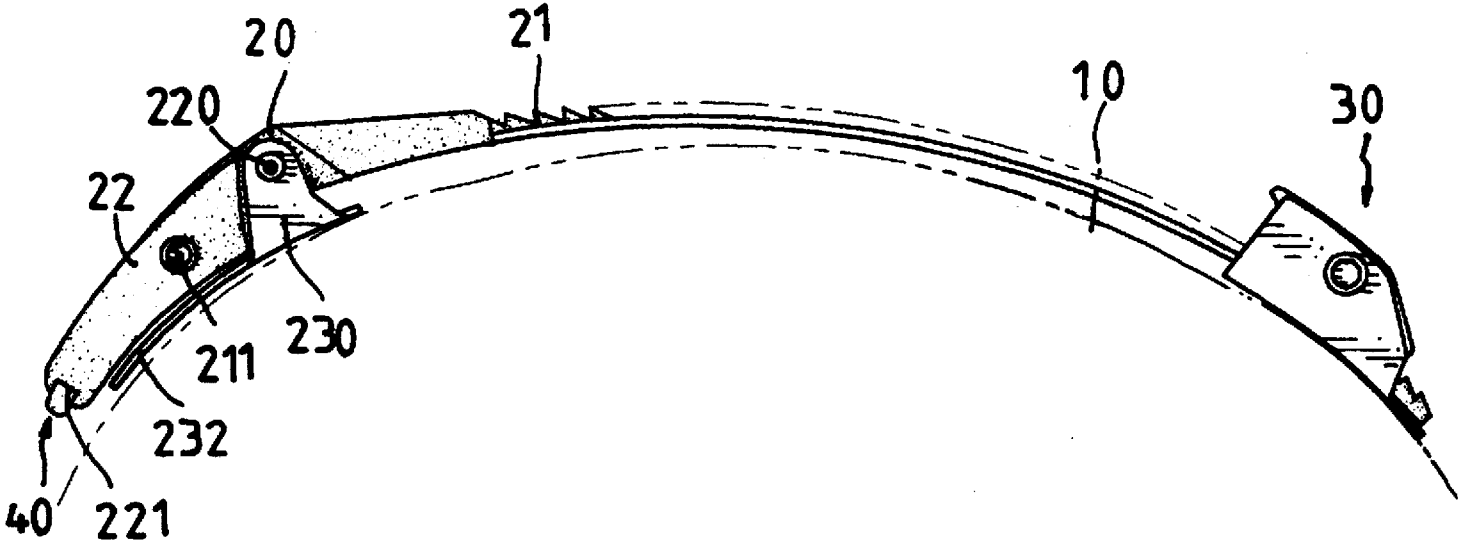
FIG. 4 is a side view showing the securing device disposed on a footwear.

Referring to FIGS. 3 and 4, a fixing member 30 is fixedly disposed to the other side of the footwear 10 and the other end of the toothed band 21 is fixedly connected to the fixing member 30. When securing the securing device, a user (not shown) pivotally pulls the receiving member 22 together with the head 20 toward a direction opposite to the fixing member 30 such that the inclined surface 413 of the second hook member 412 slides downwardly along a top of the first hook member 231 till the first hook member 231 and the second hook member 412 are engaged with each other. Therefore, the toothed band 21 is securely positioned between the fixing member 30 and the receiving member 22. When opening the securing device, the user simply pushes the actuating member 40 toward the springs 42 to depress the springs 42 so that the first hook member 231 and the second hook member 412 are disengaged with each other, and the receiving member 22 can be pivoted about the rivets 220 to loosen the toothed band 21.

Accordingly, the securing device is easily to be operated and the actuating member 40 effectively reduces possibilities of unintentional opening.

Although the invention has been explained in relation to its preferred embodiment, it is to be understood that many other possible modifications and variations can be made without departing from the spirit and scope of the invention as hereinafter claimed.

What is claimed is:

1. A securing device comprising:

a base having a bottom for attachment to a footwear, two lugs extending upwardly from two opposite sides of said bottom, and said bottom having a first hook member extending upwardly therefrom;

a receiving member having a U-shaped configuration and including a transverse portion and two arms which respectively extend from two opposite ends of said transverse portion, the arms being pivotally connected to said two lugs of said base, said transverse portion having two extending portions respectively extending downwardly from two opposite sides thereof, each of said two extending portions has a first flange extending laterally and inwardly from an inner side thereof so as to define a groove in said respective inner side of each of said extending portions, each of said first flanges having a slot defined therethrough;

an actuating member slidably received in said grooves and having two rods extending longitudinally therefrom, a spring mounted on each of said rods and said two springs contacting against a close end of each of said grooves, said actuating member having two stops extending downwardly from a bottom of two opposite sides thereof, the stops being movably inserted into said slots of said first flanges and a second hook member extending downwardly from said bottom of said actuating member for detachable engagement with said first hook member of said base, and a toothed band having a head formed at an end thereof and said head is pivotally connected between said two arms.

2. The securing device as claimed in claim 1 wherein said second hook member has an inclined surface defined in a free end thereof.

* * * * *